US005881910A

United States Patent [19]

Rein

[11] Patent Number: 5,881,910

[45] Date of Patent: Mar. 16, 1999

[54] NUMERICAL INVENTORY CONTROL DEVICE

[75] Inventor: Gary Rein, New York, N.Y.

[73] Assignee: Advertising Display Company, Lyndhurst, N.Y.

[21] Appl. No.: 914,046

[22] Filed: Aug. 17, 1997

[51] Int. Cl.[6] ..... G07F 11/00

[52] U.S. Cl. ..... 221/6; 211/59.3

[58] Field of Search ..... 221/5, 6, 270; 211/59.3; 312/71

[56] References Cited

U.S. PATENT DOCUMENTS 4,742,936 5/1988 Rein ..... 221/5

*Primary Examiner*—Kenneth Noland

*Attorney, Agent, or Firm*—Donald R. Heiner, ESQ.

[57] ABSTRACT

A Numerical Inventory Control Device for holding and then dispensing one or more items contained within the device wherein the items are gradually moved from the back toward the front of the device by a moving slideable pusher which is biased against a constant force coil spring contained in a dispenser housing attached at the back end of the pusher and wherein one end of the coil spring is affixed to the dispenser housing wherein, when product, near the front of the housing, is removed the constant force spring will cause the pusher to advance the next product toward the front for dispensing purposes. An inventory indicator sheet, essentially in the form of an endless belt, is attached at one end to the front side of the pusher and at the other end to the rear of the pusher and has one or more rows of numbers thereon, which indicate, at the front of the device, the quantity of units remaining in the dispensing device.

8 Claims, 4 Drawing Sheets

NUMERICAL INVENTORY CONTROL DEVICE

BACKGROUND OF INVENTION

1. Field of the Invention

The present invention generally involves the field of technology pertaining to a device principally for use in retail stores wherein merchandise, such as cigarette packages, are stored in rows, on shelves, and wherein the rows, which can be one or more, are perpendicular to the storage shelves, and are parallel to each other. Usually, viewed from the vantage point of a purchaser, only the first item in a row, at the front of the storage unit, is viewed and, obviously, the merchandise can be removed from the front, the middle, or the rear of the shelve and thus there is no way of knowing how many items, in this case, packages of cigarettes, are still available for sale.

Still further, obviously, if packages are removed, randomly, from the front, back, or middle and also from row to row from the display it greatly disturbs the visual appearance of the shelves. Applicant's prior U.S. Pat. No. 4,742,936 which issued May 10, 1988 substantially resolved the foregoing problems but it is submitted that the instant invention further substantially improves on that device in that a negator spring is provided rather than a coiled spring and three tracks of numbers are provided, rather than one, on an indicator sheet for reasons to be explained below. Further, the indicator sheet itself is no longer a self-coiling sheet but rather is in the form of an endless belt both ends of which are attached to a moveable platform or pusher which urges the merchandise forward. The multiple rows or tracks of numbers on the indicator sheet allows for different thickness of product in the same row since the numbers are staggered in accordance with product thickness.

2. Description of the Prior Art

The closest prior art references known to applicant is his prior issued U.S. Pat. No. 4,742,936, which differs from this invention in the particulars indicated above. That prior patent references the R. E. Taber U.S. Pat. No. 3,416,115 regarding a self-coiling sheet which can be extended and recoiled almost indefinitely without fatigue. The Taber self-coiling sheet, as used in applicant's prior patent, required a spindle at the front of the device, a guide and a pressure plate for maintaining the sheet in a vertical position with respect to a viewing window at the front of the device. Those items are eliminated by the current invention and further incorporates three tracks of numbers, rather than one to accommodate product or merchandise of varying thickness. Applicant's prior patent comprised a dispenser for the storage and dispensing of items of identical size.

None of the references cited above, singularly, or in combination teaches or even suggests the use of the unique combination of an endless belt negator spring for urging a pusher nor an indicator sheet having multiple rows of numbers to be viewed through a viewing window at the front of the device.

SUMMARY OF THE INVENTION

The instant invention comprises a generally rectangular dispenser for receiving, holding and eventually dispensing various packaged items, such as cigarettes, wherein the packaged items can be of the same or varying size or thickness when the housings are laterally connected on a storage shelf. Each separate housing comprises front and rear walls connected by laterally extending, substantially parallel sidewalls, and a package receiving and holding rail associated with each sidewall and co-extensive therewith located at some depth below the top of the housing. Each rail extends inwardly of the sidewalls and towards each other. The packages are caused to move on a pair of opposing rails when a force is exerted against the rear most package by a pusher which in turn is urged from the back to the front of the housing by a negator coil spring disposed within a negator spring housing attached at the back end of the pusher. The free end of the coil negator spring is attached near the front end of the housing, wound under the negator spring housing, and slides on a coil spring rail. The pusher slides, under the force of the negator coil spring, on a pair of pusher rails extending inwardly of the package receiving and holding rails and at a distance below those rails. The coil spring rail previously mentioned, in turn, is disposed between the pusher rails and at some distance below those rails. Thus, the housing sidewalls, package receiving and holding rails, coil spring rail, and pusher rails are all essentially co-extensive with and parallel to each other and at varying heights measured from the top of the housing. Windows are disposed through the front wall of the housing such that the number of packages remaining in the device can be determined by reading the number appearing on the indicator strip as it advances with the pusher. As items or packages are removed the number decreases reflecting less inventory, as packages are added, the pusher moves rearwardly and the numbers increase reflecting an increase in inventory in a particular housing.

It is therefore an object of the present invention to provide a numerical inventory control device for packaged material.

It is another object of the invention to provide a numerical inventory control device with an automatic numerical read out of inventory.

It is a further object of the invention to provide a numerical inventory control device which can accommodate packages of different thickness and still give an accurate read out of remaining inventory.

It is still a further object of the invention to provide such a numerical inventory control device having a pusher for moving the packaged material from the back to the front of a housing.

It is yet another object of the invention to provide such a numerical inventory control device wherein the pusher is controlled by a coiled negator spring disposed within a pusher housing.

These and further objects, features, and advantages of the invention shall become apparent from the following detailed description of an embodiment thereof when taken in conjunction with the drawings wherein like reference characters refer to corresponding parts in the several views.

DETAILED DESCRIPTION OF THE PREFERRED EMBODIMENT

Figure 1:
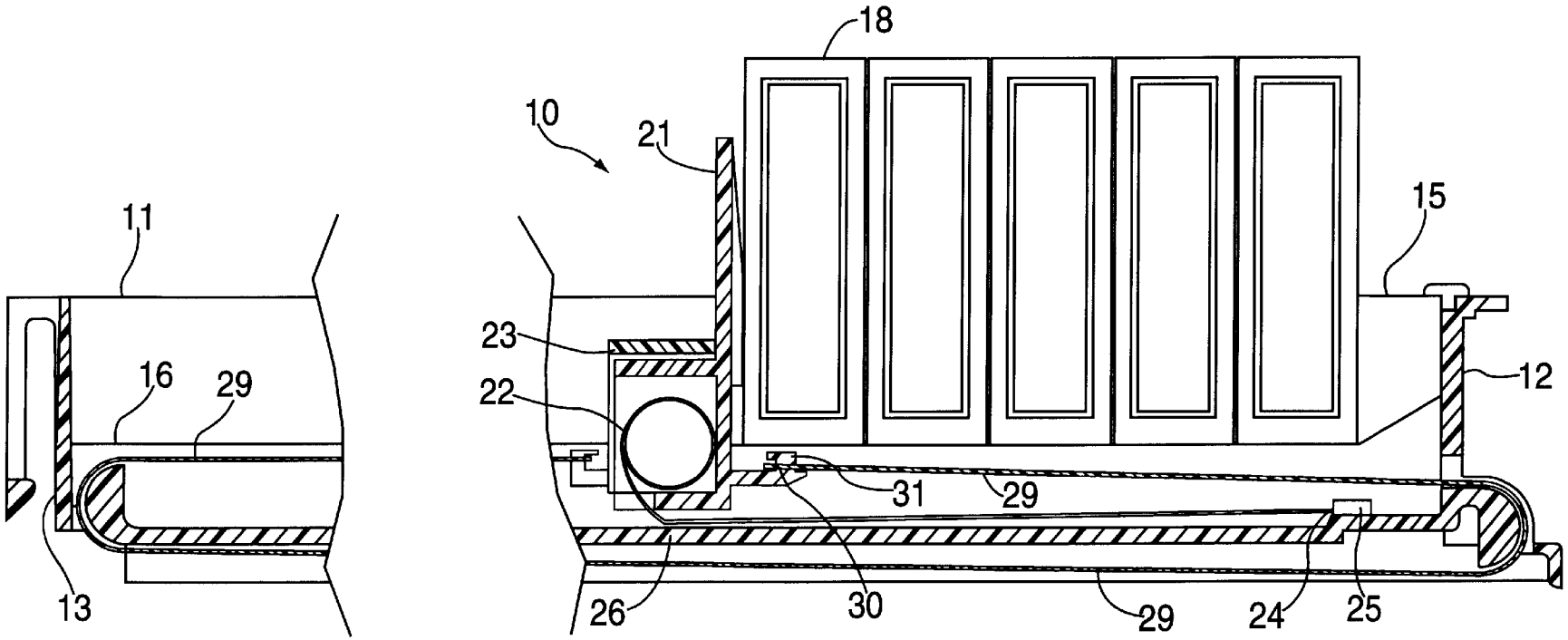
FIG. 1 is a side cross-sectional view of the entire unit showing product to be advanced and dispensed.
Figure 2:
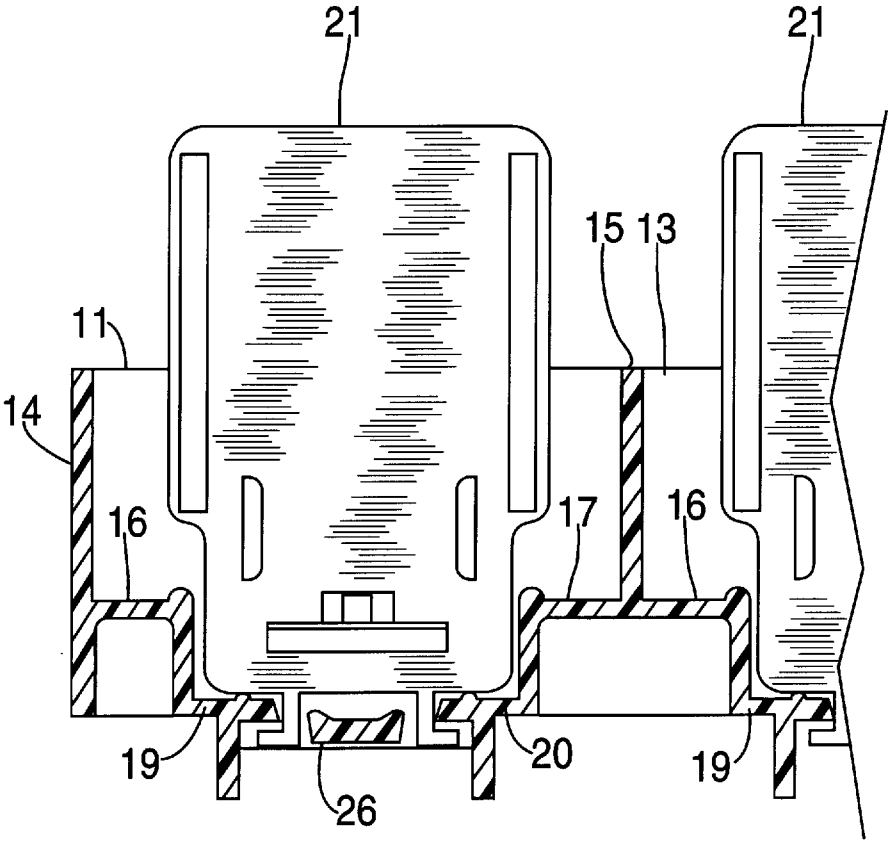
FIG. 2 is a frontal cross-section.

A numerical inventory control device especially suited for packaged goods, such as cigarettes, will now be described with reference to FIGS. 1–4*b* of the drawings.

The numerical inventory control device is shown generally as 10 in the several views having a generally rectangular housing generally shown at 11 comprising front and rear walls 12 and 13 respectively and having laterally extending, substantially parallel, spaced apart sidewalls 14 and 15 extending there between as clearly shown in the several views. Package receiving and holding rails 16 and 17 are attached to or formed with sidewalls 14 and 15 at some depth below the top of the housing with each rail 16 and 17 extending inwardly of sidewalls 14 and 15 and toward each other whereby packages 18 are caused to move on a pair of such opposing rails as will be more fully described below.

A pair of pusher rails 19 and 20 extend inwardly of package receiving and holding rails 16 and 17 and at a distance below those rails for slideably receiving a pusher 21 for exerting a force on the rear most package in the device at any given time.

A negator coil spring 22 is disposed in a negator spring housing 23 disposed at the rear of pusher 21 and the free end 24 of negator coil spring 22 is attached, by any well known means, near the front end of housing 11 such as shown at 25. The coil spring is wound under negator spring housing 23 and slides on a coil spring rail such as shown at 26. The negator coil spring thus exerts a constant force on the packaged product through pusher 21 as each package is removed since the coil will wind on itself. If packages are inserted the coil spring will unwind thereby allowing the pusher to move to the rear of the device.

The front wall 12 has a window 27 for viewing a number 28 which shows the number of packages in the device at any given time. As product is subtracted the number will decrease, as product is added the number will increase thus keeping a constant and automatic inventory control for an operator of the device.

The inventory control itself is in the form of an indicator sheet 29 essentially in the form of an endless belt attached at one end 30, by any suitable means, to the front end 31 of pusher 21 and at its other end to the back end of the pusher. Thus, the indicator sheet 21 will move as the pusher moves. This is clearly shown in FIG. 1. The sheet 29 extends under the pusher and packages, winds around a rounded front end of the device and then runs rearwardly, underneath the device, around a rounded back end of the device and then runs forward where it attaches to the rear of the negator coil spring housing 23.

Figure 3:
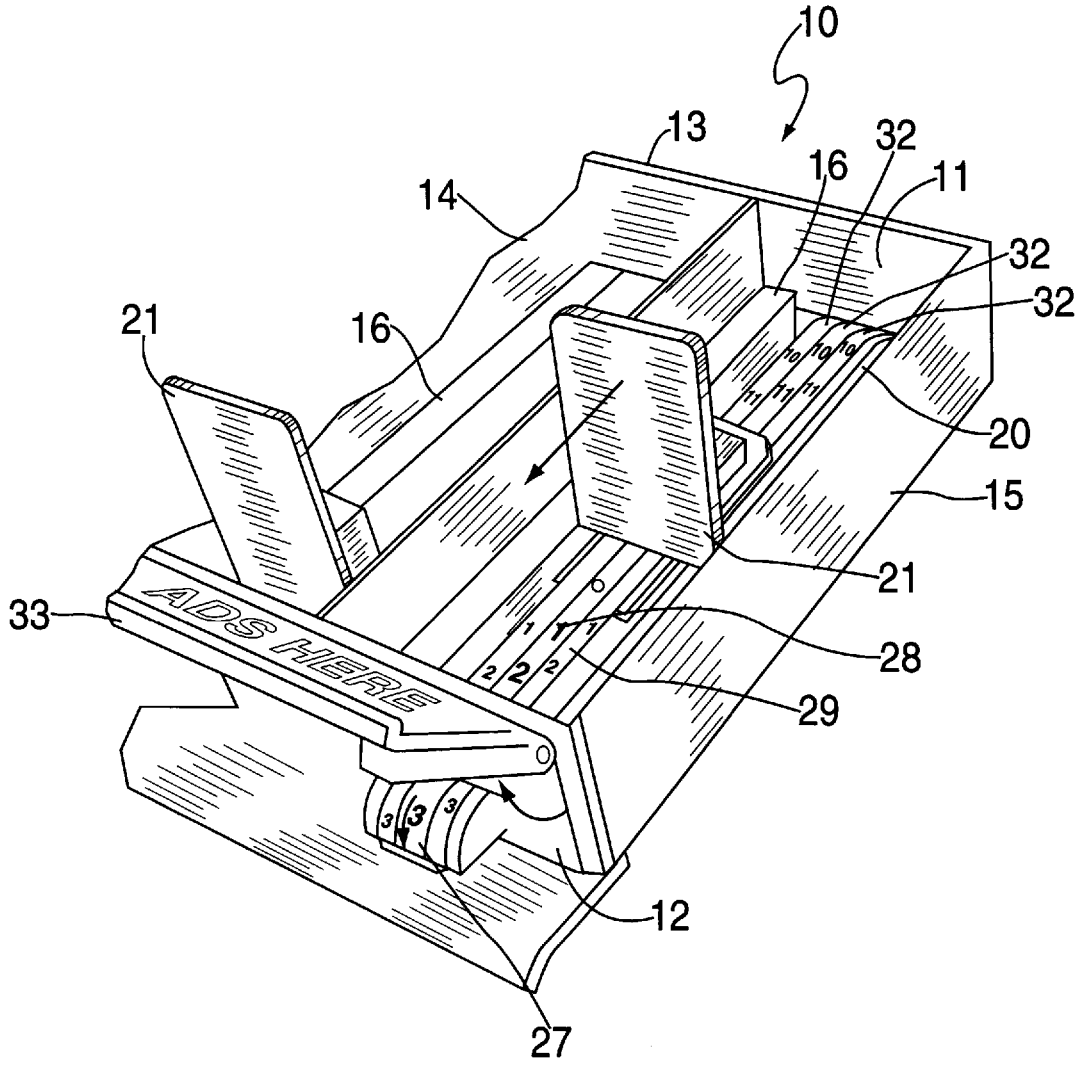
FIG. 3 is a perspective showing two side-by-side units with one showing the numerical indicator sheet, advancing pusher, read-out window, and read-out window with raised cover plate.
Figure 4A:
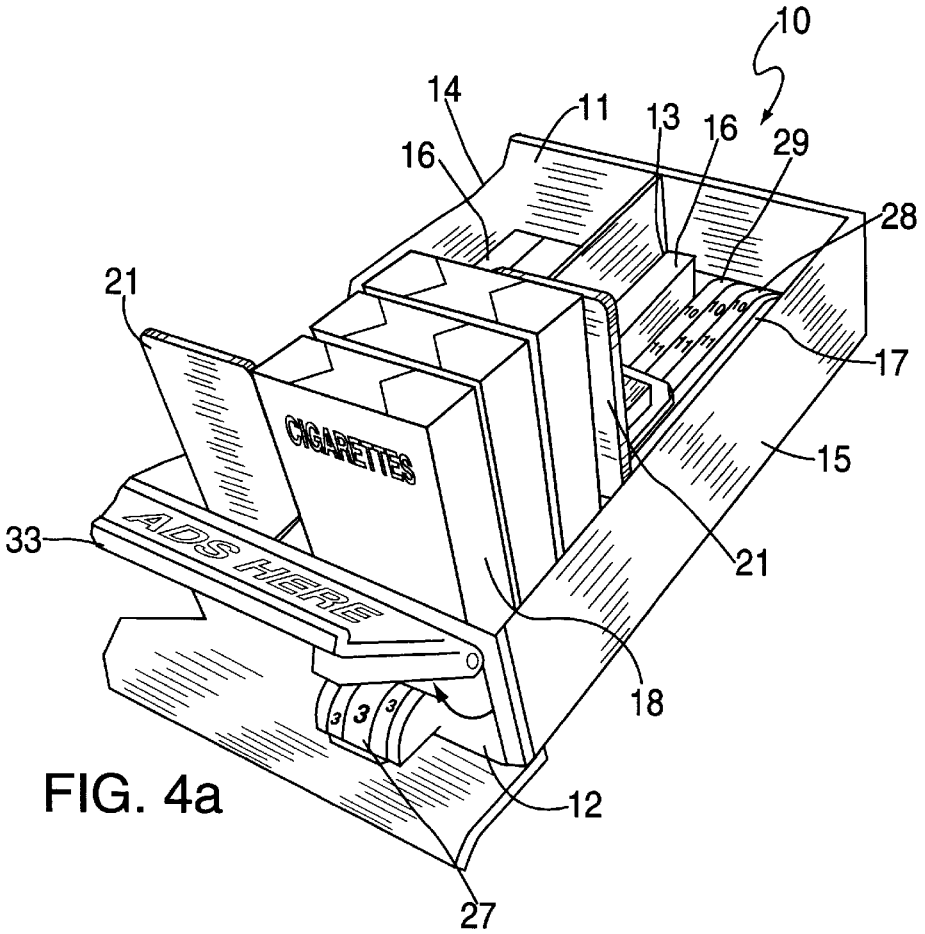
FIG. 4*a* is similar to FIG. 3 showing the packaged material to be dispensed.
Figure 4B:
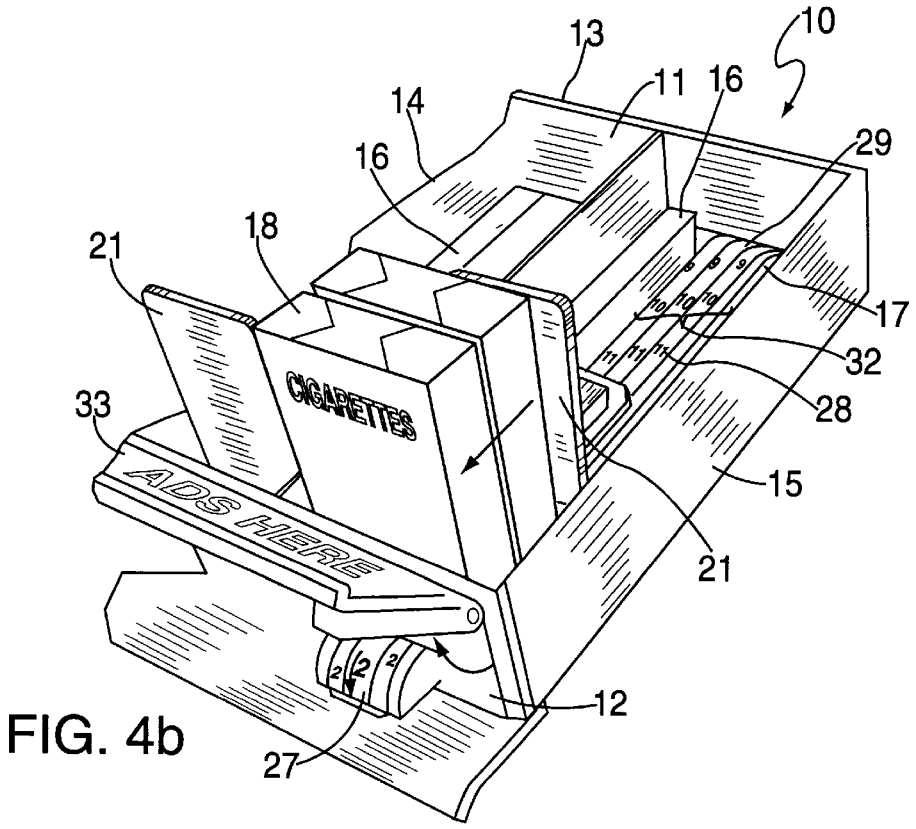
FIG. 4*b* is the same as FIG. 4A showing inventory advancing and the numerical indicator decreasing.

Imprinted on the indicator sheet 29 are one or more rows of numerals 32 as best seen in FIGS. 3–4*b*. The numbers are calibrated depending upon the thickness of the product being dispensed. Thus, this device, having three rows of numerals, can accommodate three different thicknesses of packaging. A flip-up cover plate 33 may be provided for covering the window 27 and also for receiving advertising.

As product is substracted from or added to the device, the pusher will move accordingly and thus the indicator sheet will also be caused to move in one direction or the other and thus the numeral appearing at the window will increase or decrease and thus there is a constant inventory control.

In operation, product or packages, such as cigarettes, are loaded into the housing and the pusher will be in the rear most position with the negator coil spring being unwound to its maximum and exerting forward force on the pusher. The numbers on the indicator sheet will read the maximum numeral at the window since the device will be at its maximum capacity. As a package is removed the coil spring will continue to exert a force on the pusher which will cause the pusher to advance toward the front end thereby causing the packages also to advance. The indicator sheet will also advance and the number readout at the window will decrease. If product is added, the foregoing is reversed.

Though the invention has been described and illustrated with reference to a preferred embodiment thereof those skilled in the art will appreciate that various changes and modifications in shape, size, composition, and arrangements of parts may be resorted to without departing from the spirit of the invention or scope of the subjoined claims.

What is claimed is:

1. A numerical inventory control device for receiving, holding, and dispensing packaged materials, such as cigarettes, comprising:

(a) a generally rectangular shaped housing for holding said materials to be dispensed;

(b) a pair of laterally extending substantially parallel and spaced apart sidewalls having front and rear walls connected thereto comprising said generally rectangular shaped housing;

(c) a package receiving and holding rail extending from each of said sidewalls below a top of said housing and extending inwardly of said sidewalls and towards each other;

(d) a pusher rail extending inwardly of each of said package receiving and holding rails at a distance below said rails for slideably receiving a pusher for exerting a force on the rear most of said packaged materials in said housing;

(e) means exerting a constant force on said pusher thereby causing said pusher to move in either direction toward said front or said rear wall of said generally rectangular shaped housing when packaged materials are subtracted from or added to said housing;

(f) an indicator sheet operatively associated with said pusher, having one or more rows of numerals imprinted thereon and moveable with said pusher; and, (g) a window in said front wall for viewing a number on one of said rows of numerals as said indicator sheet moves in either direction for indicating the number of packaged materials then in said housing thereby providing a constant numerical inventory control.

2. The device of claim 1 wherein said means for exerting a constant force on said pusher is a negator coil spring disposed at the rear of said pusher.

3. The device of claim 2 wherein said negator coil spring is disposed in a negator spring housing disposed at the rear of said pusher and moves with said pusher.

4. The device of claim 3 wherein a free end of said negator coil spring is attached near the front end of said housing on a negator coil spring rail which extends between the front and rear walls of said housing whereby said negator coil spring can wind and unwind in said negator spring housing responsive to the direction of travel of said pusher.

5. The device of claim 4 wherein said indicator sheet is an endless belt attached at one end to a front end of said pusher and at its other end to a back end of said pusher whereby said indicator sheet is caused to move in either direction, forward or backward, as said pusher moves.

6. The device of claim 5 wherein said rows of numbers are calibrated on said indicator sheet depending upon the thickness of said packaged materials whereby said numerical control device can accommodate a plurality of packaged thicknesses and accurately read out the number of said packages in said housing at any time.

7. The device of claim 6 comprising a flip-up cover plate for covering and uncovering said window and thus alternately covering up and uncovering the said number on said indicator sheet appearing at the window.

8. The device of claim 7 wherein said flip-up cover plate is adapted to receive advertising material.

* * * * *